United States Patent [19]

Bijma

[11] 4,117,379

[45] Sep. 26, 1978

[54] METHOD OF ADJUSTING A MAGNETIC DEFLECTION UNIT OF A CATHODE RAY TUBE, CATHODE RAY TUBE HAVING A DEFLECTION UNIT OR REFERENCE POINTS ADJUSTED ACCORDING TO SAID METHOD, AND A DEFLECTION UNIT PROVIDED WITH REFERENCE POINTS ADJUSTED ACCORDING TO SAID METHOD

[75] Inventor: Jan Bijma, Eindhoven, Netherlands

[73] Assignee: U.S. Philips Corporation, New York, N.Y.

[21] Appl. No.: 807,167

[22] Filed: Jun. 16, 1977

[30] Foreign Application Priority Data

Jul. 7, 1976 [NL] Netherlands ..... 7607472

[51] Int. Cl.[2] ..... H01J 29/56

[52] U.S. Cl. ..... 315/370

[58] Field of Search ..... 315/370; 313/425; 335/211, 212, 213

[56] References Cited

U.S. PATENT DOCUMENTS

| | | | |
|---|---|---|---|
| 3,629,751 | 12/1977 | Massa | 335/212 |
| 3,714,500 | 1/1973 | Kaashoek | 315/370 |
| 3,793,554 | 2/1974 | Rossaert | 315/370 |
| 3,898,520 | 8/1975 | Gerritsen et al. | 315/370 |

*Primary Examiner*—Howard A. Birmiel
*Assistant Examiner*—T. M. Blum
*Attorney, Agent, or Firm*—Frank R. Trifari; Henry I. Steckler

[57] ABSTRACT

A method for aligning a deflection unit on an in line CRT uses a multipole field generated by the deflection unit. The center beam is turned on and the deflection unit aligned until it makes a single dot pattern on the CRT screen.

18 Claims, 8 Drawing Figures

Figure 1:
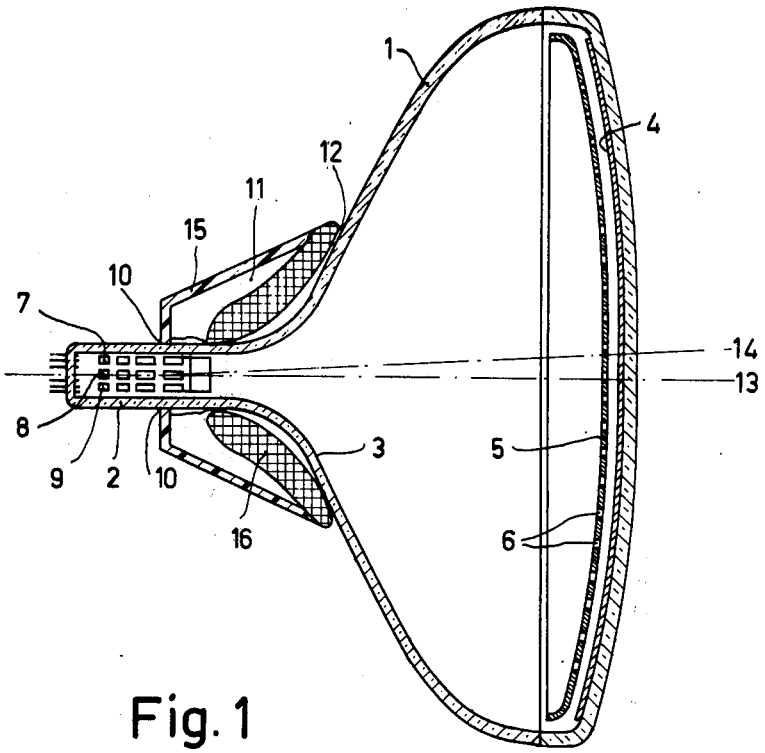

METHOD OF ADJUSTING A MAGNETIC DEFLECTION UNIT OF A CATHODE RAY TUBE, CATHODE RAY TUBE HAVING A DEFLECTION UNIT OR REFERENCE POINTS ADJUSTED ACCORDING TO SAID METHOD, AND A DEFLECTION UNIT PROVIDED WITH REFERENCE POINTS ADJUSTED ACCORDING TO SAID METHOD

The invention relates to a method of adjusting a magnetic deflection unit around the neck and the funnel-shaped part of the envelope of a cathode ray tube of the in-line-type for displaying coloured pictures, which neck comprises three electron guns situated in one plane and in which opposite to said electron gun a display screen is arranged in which the deflection unit is slid around the neck until the desired axial position is obtained and is rotated around the axis of the cathode ray tube in such manner that the picture and line deflection take place in the desired direction.

The invention also relates to a cathode ray tube having a magnetic deflection unit or reference points which are adjusted according to said method, and to a deflection unit provided with reference points adjusted according to said method.

It is known to evaluate the adjustment of the deflection unit of a colour display tube of the in-line-type with reference to the frame distortion and convergence errors, as described in Philips Product Information 58, 20 AX for 110° Colour Television, Feb. 1, 1975. Errors, if any, in the adjustment can be corrected by passing differential currents through the individual winding packets and/or through extra four-pole windings present in the deflection unit. The evaluation of the adjustment with reference to the frame distortion and covergence errors is time-consuming and the correction by means of differential currents is expensive as a result of the extra circuits which are necessary to produce the correct currents.

From the article "A new color picture tube system for portable T.V. receivers", I.E.E.E. Trans Broadcast Telev. Receivers (N.S.) 18, 193–200 (1972) it is known to adjust the magnetic field of the deflection unit with respect to the beams by moving the deflection unit mechanically horizontally and vertically in a plane at right angles to the tube axis until the axis of the magnetic deflection unit is aligned with the electron beam triplet. The criterion for a good alignment is the convergence pattern. This criterion for a good alignment is the convergence pattern. This method is combersome, while the deflection unit should be capable of performing movements at right angles to the tube axis.

It is also known to clamp the deflection unit around the neck with its side remote from the display screen and to tilt the side facing the display screen in such manner that a minimum frame distortion is obtained. This method is not rapid and simple either.

It is therefore the object of the present invention to provide a simple and rapid method of adjusting a magnetic deflection unit around the neck and the funnel-shaped part of the envelope of a cathode ray tube of the in-line-type for displaying coloured pictures, which adjustment can be carried out truly mechanically and with few auxiliary means and extra circuits.

According to the invention, such a method is characterized in that the deflection unit, with its side remote from the display screen, is centred substantially around a point on the axis of the central electron gun, a dy namic magnetic mutipole field, in general a four-pol field, is generated by means of the deflection unit and a electron beam is generated with the central electro gun, after which the side of the deflection unit facin the display screen is tilted around the point on the axi of the central electron gun in such manner that a poin is displayed on the display screen by the electron beam The invention is based on the recognition of the fac that eccentricity errors of the axis of the electron gu with respect to the axis of the deflection unit at the are of the display screen are generally much larger at th area of the electron gun. According to the invention th adjusting process is simplified by generating a dynami magnetic multipole field, generally a four-pole field, b means of the deflection unit. The deflection unit is nov tilted so that a circular dot is displayed on the displa screen, which is the case when the electron beam origi nating from the electron gun coincides substantiall with the optical axis of the magnetic four-pole and i hence substantially not displaced by said field.

In order to be able to use said method successfully the deflection units should be of a reasonable quality This means that the halves of the deflection coil ar situated substantially symmetrically. The line of inter section of these two planes then forms the axis of th deflection unit. As long as the electron beam and th axis of the fourpole field do not coincide substantially the beam is deflected by the varying multipole field an a usually curved line is displayed on the display screen A magnetic deflection unit adjusted according to th invention is then fixed on the envelope. This may b done in known manner by means of adhesive, adjustabl screw connections, and the like.

It is alternatively possible to provide the envelop and/or deflection unit with reference points which ar provided on the envelope and which fix the adjustmen of the deflection unit with respect to the envelop unambigously. As a result of this it is possible to remov the deflection unit from the cathode ray tube and t provide it again afterwards in the same position.

In addition it is possible by means of a calibrate deflection unit to provide in this manner referenc points on envelopes or reference points on deflectio units by means of a calibrated envelope.

Dependents on the type of deflection unit, multipol fields can be generated in a number of manners. In th so-called double-saddle coils a dynamic magnetic four pole field is obtained by energizing one of the coi halves of the picture deflection coil and/or line deflec tion coil with an alternating voltage in such manner tha the magnetic flux in said coil half (halves) is directe opposite to the magnetic flux in the associated other coi half (halves). In so-called double toroidal coils a dy namic magnetic four-pole field is obtained by energizin one of the coil halves of the picture deflection coils an the line deflection coil with an alternating voltage i such manner that the magnetic flux in said coil halves i directed opposite to the magnetic flux in the associate other coil halves.

Sometimes, four-pole windings or eight-pole wind ings are incorporated in a magnetic deflection coil, wit which the said multipole field can also be generated The alternating voltage used may be the picture or lin deflection voltage used in the operating condition of th cathode ray tube, so that no extra supply source is nec essary for said adjusting method.

Figure 2:
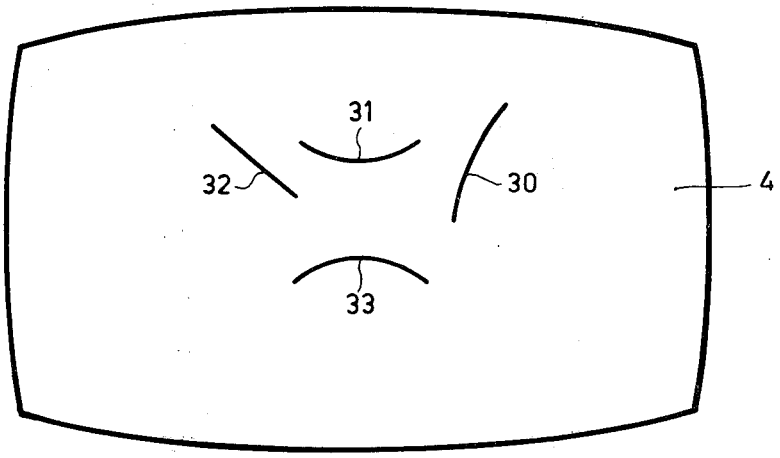
Figure 3:
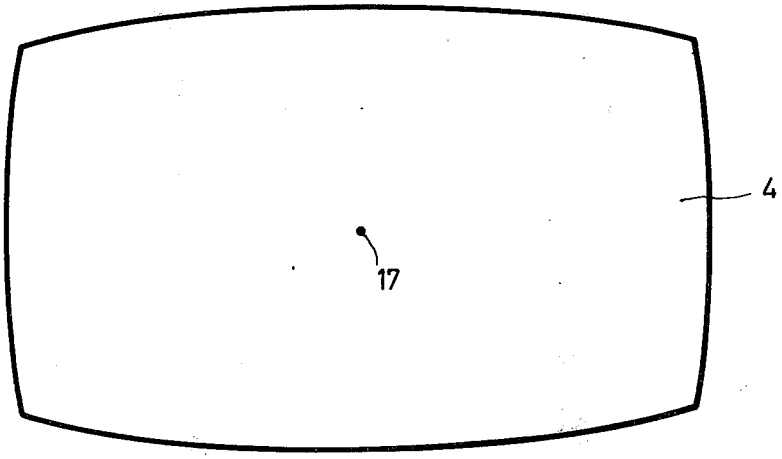

The invention will now be described in greater detail with reference to a drawing, in which FIG. 1 is a sectional view of a cathode ray tube, FIG. 2 shows a display screen of a display tube with a non-adjusted deflection unit during the adjustment, FIG. 3 shows a display screen of a display tube with an adjusted deflection unit during the adjustment, and FIGS. 4 to 8 show a few ways of energizing a deflection unit.

The cathode ray tube shown in the sectional view in FIG. 1 comprises a glass envelope 1 which has a neck 2 and a funnel-shaped portion 3. Three electron guns 7, 8 and 9 are provided in the neck. The axis of the central gun 8 coincides substantially with the longitudinal axis of the cathode ray tube. The electron beams generated by the electron guns are deflected by a deflection unit 11 which is centred around the neck 2 by means of its end 10. The deflection unit in this case consists of a housing 15 accommodating coils 16. The electron beams impinge on the display screen 4 through the apertures 6 in the colour selection electrode shadow mask 5. The three electron beams pass through the apertures 6 at a small angle to each other and consequently each impinge on stripe-shaped phosphor regions of only one colour. During the adjustment of a cathode ray tube the deflection unit 11 is slid on the neck 2 in such manner that the field and line deflection take place in the correct direction. However, the deflection fields may need to be tilted, as, the axis 13 of the neck 2 and the gun 8 may not coincide with the axis 14 of the deflection unit 11, to produce frame distortions and convergence errors. Up till now these were corrected by passing differential currents through the coils of the deflection unit so that the axes 13 and 14 substantially coincides. A number of extra circuits were necessary to generate the differential currents. It is also known to tilt and translate the deflection unit during adjustment, with a minimum frame distortion as a criterion for good adjustment.

According to the invention, the adjustment is made much simpler if, a dynamic multipole field is produced by means of the deflection unit and an electron beam is generated by means of the electron gun 8. Before the position of the deflection unit has been adjusted the axis 13 of the electron gun does not yet substantially coincide with the axis 14 of the deflection unit and a display will be produced on the display screen 4 as shown in FIG. 2, in the presence of the multipole field. As a matter of fact, the electron beam is deflected by the dynamic multipole field which in this case is a four-pole field and usually a curved line display is produced. This line has a shape which depends on the position of the beam in the four-pole field. The lines 30, 31, 32 and 33 denote a few examples of shapes which such lines might occupy. Because the beam is also incident on the display screen in a small area, the beam current should be chosen to be low so as to avoid burning-in of the display screen.

It is shown in FIG. 3 that, if the axis 14 of the deflection unit and the axis 13 of the electron gun coincide or are made to coincide by tilting the deflection unit, a dot 17 becomes visible on the display screen 4. In that case the dynamic four-pole field no longer deflects the electron beam.

When the deflection unit 11 has been adjusted, its position should be fixed on the envelope 1. This may be done, for example, by providing adjusting wedges between the end 12 (see FIG. 1) of the deflection unit and the envelope by gluing or by means of a screw connection.

It is alternatively possible to provide reference points on the envelope and/or on the deflection unit which fix the adjustment of the deflection unit unambigously. These reference points may be, for example, three studs or a flat portion of the envelope against which the deflection unit is located and may consist of a quantity of plastisized material, for example a thermo-plastic material, which is poured between the deflection unit and the envelope or may be a ring or plates of a selected thickness which are adhered to the envelope. In this manner the axial purity adjustment in the direction of the axis of the cathode ray tube in the usual way can be fixed simultaneously.

By positioning the electron guns 7, 8 and 9 accurately about the axis of the neck 2 during sealing them within the envelope, it is not difficult to center the deflection unit 11 around the neck 2 in the region of the end 10. It has been found that even when the axis 14 of the deflection unit at the region of the end 10 does not coincide entirely with the axis of the gun 8 but it situated at a small distance therefrom, a good adjustment of the deflection unit can nevertheless be obtained in the manner described.

Figure 4:
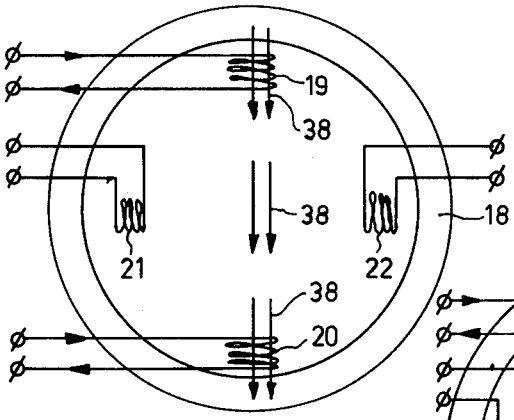

FIG. 4 shows diagrammatically a deflection unit having two pairs of saddle-shaped coils and having a core 18 (yoke ring) and the coil halves of the line deflection coils being 19 and 20. Deflection in the operating condition of the display tube takes place by energizing the coil halves 19 and 20 with an alternating (f.i. a saw-tooth) deflection current in the direction indicated by the arrows on the coil connections. The frequency of this current may be equal to the usual deflection current frequency or may be lower f.i. 50 or 60 Hz so that the generated magnetic flux 38 due to these two coil halves lies in the same direction.

Figure 5:
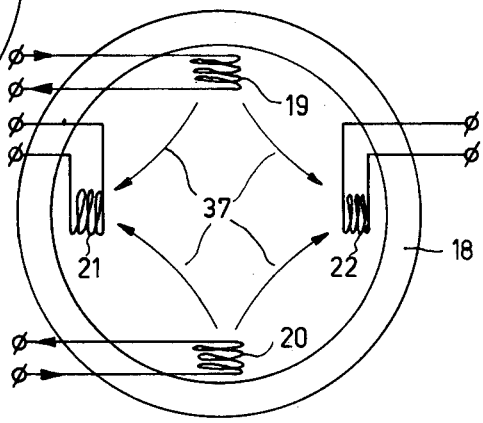

FIG. 5 shows diagrammatically how a dynamic magnetic four-pole field 37 can be obtained in a double saddle-shaped coil as showed in FIG. 4. The current now flowing in opposite directions in the coil halves 19 and 20 as indicated by the arrows on the coil connections. It will be obvious that such a four-pole field can also be generated by means of the field deflection coil halves 21 and 22, possibly together with the line deflection coils.

It is alternatively possible to obtain a multipole field with the saddle-shaped coil of a hybrid deflection unit consisting of a saddle-shaped coil in combination with a toroidal coil by energizing only the two parts of the saddle-shaped coil of said deflection unit with currents flowing in opposite directions.

Figure 6:
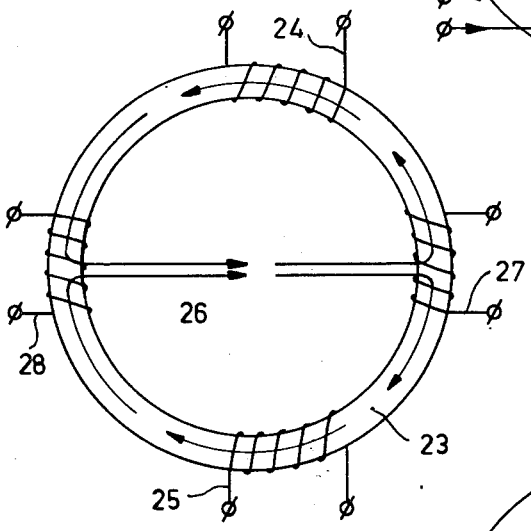

FIG. 6 shows diagrammatically a double toroidal deflection unit with core 23 (yoke ring). The field deflection coil halves 24 and 25 generate the deflection field 26 in normal operations and a field at right angles thereto can be generated by means of the line deflection coil halves 27 and 28.

Figure 8:
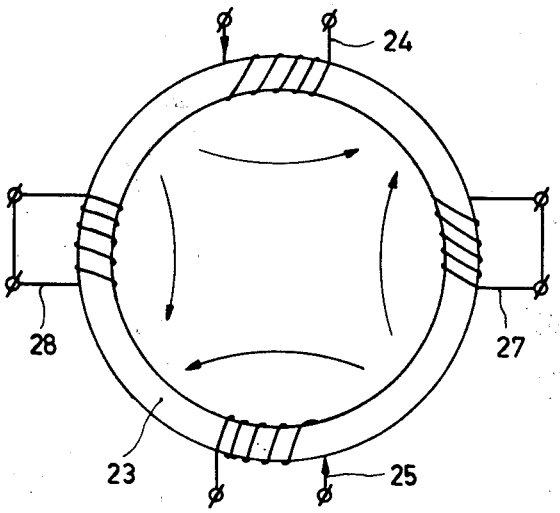
Figure 7:
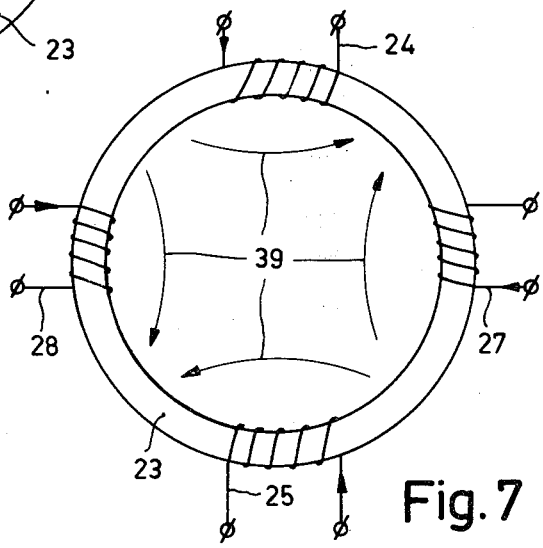

FIG. 7 shows diagrammatically how a dynamic quadrupolar field 39 can be obtained by opposite energization with an alternating deflection current of the line and field deflection coil halves. It is also possible in such a double toroidal deflection unit to energize only the line or field deflection coils, to obtain the quadrupolar field. In such case the non-energized coil halves should be short-circuited as is shown in FIG. 8.

What is claimed is:

1. A method of adjusting a magnetic deflection unit around the neck and the funnel-shaped part of the envelope of a cathode ray tube of the in-line-type for displaying color pictures, which neck has three electron guns situated in one plane and in which opposite to said electron guns a display screen is situated, said method comprising sliding the deflection unit around the neck until the desired axial position is obtained, rotating said unit around the axis of the cathode ray tube until the frame and line deflection take place in the desired direction, and centering the side of said unit remote from the display screen substantially around a point on the axis of the central electron gun by generating a dynamic magnetic multipole field by means of the deflection unit, generating an electron beam by means of the central electron gun, and thereafter tilting the side of the deflection unit facing the display screen around the point on the axis of the central electron gun until a dot is displayed on the display screen by the electron beam.

2. A cathode ray tube having a magnetic deflection unit adjusted according to claim 1.

3. A method as claimed in claim 1, further comprising thereafter fixing the deflection unit on the envelope.

4. A cathode ray tube having a magnetic deflection unit adjusted according to claim 3.

5. A method as claimed in claim 1, further comprising thereafter providing reference points on at least one of the envelope and the deflection unit, thereby fixing the adjustment of the deflection unit relative to the envelope unambiguously.

6. A cathode ray tube having reference points adjusted according to claim 5.

7. A deflection unit having reference points adjusted according to claim 5.

8. A method as claimed in claim 1, wherein said step of generating a multipole field comprises generating a four pole field.

9. A method as claimed in claim 8, wherein the dynamic magnetic multipole field is obtained by energizing one of the coil halves of at least one of the frame deflection coil and line deflection coil of a double saddle-shaped coil with an alternating voltage in such manner that the magnetic flux in at least said coil half is directed opposite to the magnetic flux in at least the associated other coil half.

10. A cathode ray tube having a magnetic deflection unit adjusted according to claim 9.

11. A method as claimed in claim 9 wherein the alternating voltage comprises one of the frame and line deflection voltages used in the operating condition of the cathode ray tube.

12. A cathode ray tube having a magnetic deflection unit adjusted according to claim 11.

13. A method as claimed in claim 8, wherein the dynamic magnetic multipole field is obtained by energizing one of the coil halves of the frame deflection coil with the line deflection coil of a double toroidal coil with an alternating voltage in such manner that the magnetic flux in the coil halves is directed opposite to the magnetic flux in the associated other coil halves.

14. A method as claimed in claim 13, wherein the alternating voltage comprises one of the frame and line deflection voltages used in the operating condition of the cathode ray tube.

15. A cathode ray tube having a magnetic deflection unit adjusted according to claim 13.

16. A method as claimed in claim 8, wherein the dynamic magnetic multipole field is obtained by energizing one of the coil halves of only one of the frame deflection coil and the line deflection coil of a double toroidal coil with an alternating voltage in such manner that the magnetic flux in said coil half is opposite to the magnetic flux in the associated other coil half, and short circuiting the non-energized coil halves.

17. A method as claimed in claim 16, wherein the alternating voltage comprises one of the frame and line deflection voltages used in the operating condition of the cathode ray tube.

18. A cathode ray tube having a magnetic deflection unit adjusted according to claim 16.

* * * * *

UNITED STATES PATENT OFFICE

CERTIFICATE OF CORRECTION

Patent No. 4,117,379 Dated September 26, 1978

Inventor(s) Jan Bijma

It is certified that error appears in the above-identified patent and that said Letters Patent are hereby corrected as shown below:

Col. 5 line 13, After "gun" insert -- , said centering step first comprising -- and before "generating" delete "by"

Signed and Sealed this

Third Day of February 1981

[SEAL]

Attest:

RENE D. TEGTMEYER

Attesting Officer

Acting Commissioner of Patents and Trademarks